United States Patent [19]

Strange

[11] Patent Number: 4,657,318

[45] Date of Patent: Apr. 14, 1987

[54] CABINET HAVING DOOR BRAKING ASSEMBLY

[75] Inventor: Patrick E. Strange, Jasper, Ind.

[73] Assignee: Kimball International, Inc., Jasper, Ind.

[21] Appl. No.: 877,703

[22] Filed: Jun. 20, 1986

Related U.S. Application Data

[63] Continuation of Ser. No. 618,538, Jun. 8, 1984, abandoned.

[51] Int. Cl.[4] ..... E06B 9/14

[52] U.S. Cl. ..... 312/297; 160/201

[58] Field of Search ..... 312/297; 160/201

[56] References Cited

U.S. PATENT DOCUMENTS

| | | | |
|---|---|---|---|
| 1,862,654 | 6/1932 | Booth | 312/297 |
| 3,350,152 | 10/1969 | Bang | 312/297 |
| 3,426,829 | 2/1969 | McDaniel et al. | 160/201 |
| 3,532,153 | 10/1970 | D'Anka | 312/297 |

FOREIGN PATENT DOCUMENTS

| | | | |
|---|---|---|---|
| 180055 | 3/1957 | Sweden | 160/201 |

*Primary Examiner*—Kenneth J. Dorner
*Assistant Examiner*—Joseph Falk
*Attorney, Agent, or Firm*—Jeffers, Irish & Hoffman

[57] ABSTRACT

A cabinet comprising an enclosure with a front surface in which there is an opening. A tambour door is slidably attached to the enclosure. The tambour door is movable between an open position, in which the opening provides direct access to the enclosure interior, and a closed position in which the opening is closed by the door. The cabinet further includes a rear brake means for exerting a force opposing the movement of the tambour door from the open to the closed position when engaged by the tambour door. The tambour door engages the rear brake means at a first selected distance from the closed position that is sufficiently great so that the rear brake means can exert an adequate opposing force on the tambour door so that the tambour door gently closes.

8 Claims, 11 Drawing Figures

CABINET HAVING DOOR BRAKING ASSEMBLY

This is a continuation of application Ser. No. 618,538, filed June 8, 1984 now abandoned.

BACKGROUND OF THE INVENTION

This invention relates to cabinets having sliding flexible doors, and in particular, to a braking mechanism for a sliding flexible door.

One style of cabinet can comprise an enclosure having an opening which is selectively closed by a sliding flexible door. The flexible door is slidably mounted to the enclosure with the enclosure and door comprising the total cabinet.

In cabinets of a relatively large size, the flexible door may be of a considerable weight so that as the door nears the end of its travel from either the open to the closed position or the closed to the open position, gravitational forces exerted upon the door cause it to rapidly increase its speed of travel. The result of which is that in the absence of any braking mechanism the door may either slam closed or slam open. Both of these results are undesirable.

Heretofore, cabinets utilizing a flexible door slidably mounted to the enclosure thereof have used a spring force biasing arrangement that is permanently mounted to the door. While this arrangement has not been unsatisfactory, it has resulted in the biasing arrangement constantly exerting a force on the door. In other words, a force is exerted on the door at points during the travel thereof when the force is not needed. The result of which is that the door does not operate with optimum ease and efficiency at all points along its travel.

It would thus be desirable to provide an improved cabinet utilizing a sliding flexible door having a braking mechanism wherein the braking mechanism selectively engages the door only at times when the force exerted by the braking mechanism is required.

SUMMARY OF THE INVENTION

One form of the invention provides a cabinet comprising an enclosure having an opening therein. A tambour door is slidably attached to the enclosure so as to selectively close the opening. The door is slidable between an open position in which access to the interior of the closure is provided through the opening, and a closed position in which the tambour door closes the opening. The cabinet further includes a brake means for restraining movement of the tambour door as it travels from the open to the closed position, said brake means being operative to restrain the door during only a selected portion of its travel from the open to the closed position.

Another form of the invention provides a cabinet comprising an enclosure including a front surface and a pair of side surfaces. The front surface has an opening contained therein. A tambour door is slidably attached to the enclosure adjacent the opening. The door is movable between an open position in which the opening provides direct access into the enclosure interior and a closed position in which the opening is closed by the tambour door.

The door further includes a rear brake means, mounted to the enclosure, for exerting a force opposing the movement of the tambour door from the open to the closed position when engaged by the tambour door.

The tambour door engages the rear brake means at a first selected distance from the door's closed position.

The cabinet further includes a front brake means, also mounted to the enclosure, for exerting a force opposing the movement of the tambour door from the closed to the open position when engaged by the tambour door. The tambour door engages the first brake means at a second preselected distance from its open position.

Another form of the invention provides a braking assembly for a tambour door that is slidably connected to an enclosure and wherein the door is movable between an open and a closed position. The braking assembly comprises a projection mounted to the door, and an engagement means, mounted to the enclosure, for being selectively engaged by the projection at a selected point along the travel of the door from the open to the closed position. A spring means, which connects the engagement means to the enclosure, for exerting a biasing force opposing the movement of the door when the engagement means engages the projection.

Another form of the invention provides a cabinet comprising an enclosure including a front surface and a pair of side surfaces. The front surface contains an opening therein. A tambour door is slidably connected to the enclosure adjacent the opening. The tambour door is movable between an open position in which the opening provides direct access into the enclosure interior and a closed position in which the opening is closed by said tambour door. The tambour door is of a specific weight.

A projection is mounted to the tambour door. An elongate cable is mounted to the enclosure by a pair of springs having a specific spring force constant. The cable is mounted so as to extend across the travel path of the projection and so that the projection engages the cable at a specific point along the travel of said tambour door. The springs exert an opposing force on the door while the projection engages the cable. The specific point is a selected distance from the closed position of said tambour door wherein the selected distance is sufficiently great in view of the weight of said door and the spring force constant of the springs to enable the springs to exert an adequate opposing force on the door so that the door gently closes.

It is an object of the invention to provide an improved cabinet utilizing a flexible door having a braking mechanism.

It is another object of the invention to provide an improved cabinet utilizing a flexible door having a braking mechanism wherein the braking mechanism engages the door only at points along its travel that its braking capabilities are required.

BRIEF DESCRIPTION OF THE DRAWINGS

The above-mentioned and other features and objects of the present invention, and the manner of obtaining them, will become more apparent and the invention itself will be best understood by reference to the following description of an embodiment of the invention taken in conjunction with the accompanying drawings.

DETAILED DESCRIPTION OF SPECIFIC EMBODIMENTS

Figure 1:
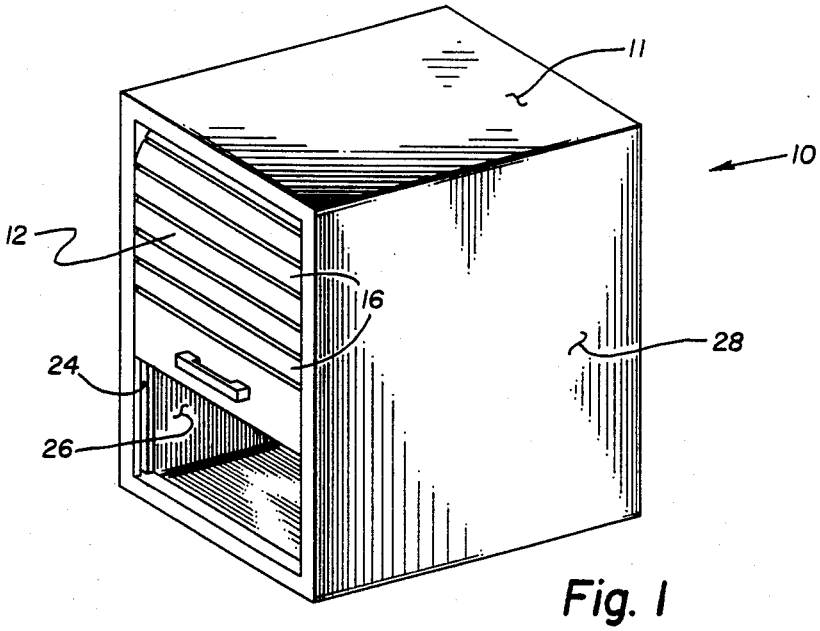
FIG. 1 is a front perspective view of a cabinet utilizing a tambour door.

Referring to the drawings, there is illustrated a cabinet generally designated as 10. Cabinet 10 includes an enclosure 11 having front, rear, top, bottom and opposite side surfaces 26 and 28. The front surface contains a relatively large opening therein. A tambour door 12 is slidably mounted to enclosure 11 so as to selectively close the opening in the front surface.

Tambour door 12 is of a general rectangular shape, and includes a flexible backing 14 made of cloth or the like having a plurality of elongate slats 16 mounted thereto as by gluing. Each slat 16 has opposite ends 18 and 20. A roller 22 is mounted to each slat 16 at the opposite ends 18 and 20 thereof. A U-shaped track or channel 24 is contained within of each side surface 26 and 28 of enclosure 11. Each track 24 opens to the interior of the enclosure 11 so that rollers 22 are slidably received within tracks 24. Tambour door 12 can thus slide between its fully open and fully closed positions.

In cabinets of a relatively large size, the tambour door may be of a considerable weight. This fact accentuates the effect gravity has on the travel of the tambour door as it nears either the open or closed position. As can be appreciated in view of the U-shaped construction of the tracks, when the door is to either side of the equilibrium position the imbalance in gravitational force acts to further drive the door towards the side that more of it is already on.

For example, as the tambour door is moved from the open to the equilibrium position, a certain force is needed to overcome the gravitational force exerted by the weight of the tambour door. When the door is at the equilibrium position it will stay in that position since the gravitational forces acting to drive the door to one side or the other are generally equal. However, in the absence of any sort of braking mechanism, once the tambour door passes the equilibrium position gravity acts to accelerate the speed of travel of the door until it reaches the closed position. It is the function of the rear braking assembly described below to exert a counteracting or opposing force on the door so as to prevent it from accelerating to an undesirably high speed.

Tambour door 12 includes a rear slat 30 which is essentially comprised of a pair of slats like slats 16 connected together at their rear surfaces. The result of which is that rear slat 30 is twice as large as the other slats 16. The rear edge of flexible backing 14 is connected to rear slat 30. A projection 32 such as a bolt is mounted to the bottom surface of rear slat 30. Projection 32 depends downwardly from rear slat 30.

Figure 2:
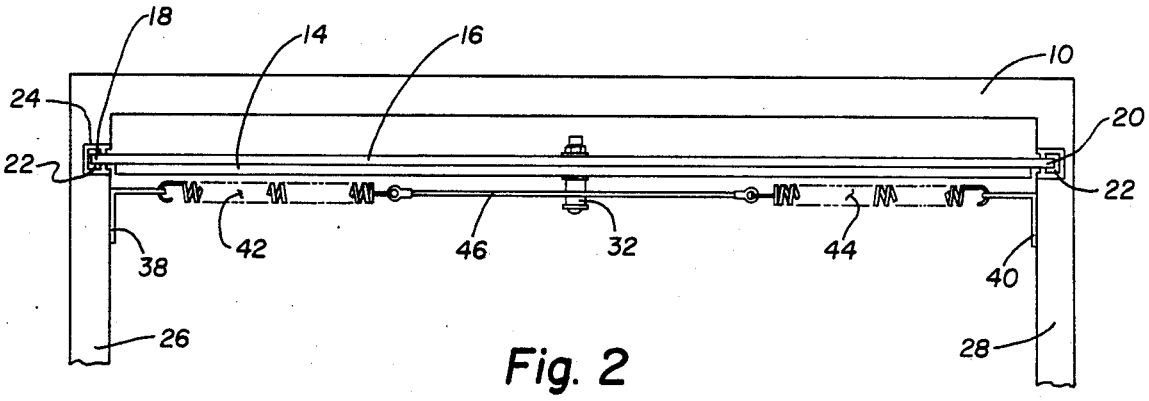
FIG. 2 is a front view of the upper portion of the cabinet and tambour door illustrated in FIG. 1.
Figure 3:
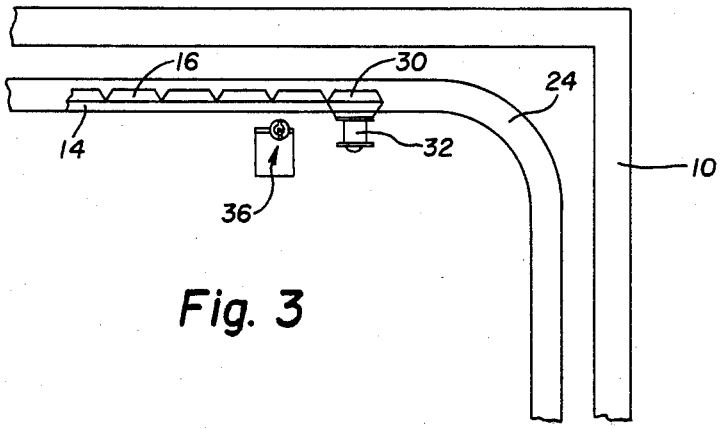
FIG. 3 is a side view of a part of upper portion of the cabinet and tambour door illustrated in FIG. 1.

Rear brake assembly is generally designated as 36. Referring more specifically to FIGS. 2 and 3, rear brake assembly 36 includes a pair of brackets 38 and 40 mounted to the interior surface of side walls 26 and 28, respectively. Elongate springs 42 and 44 are attached at one end thereof to brackets 38 and 40, respectively. The other ends of elongate springs 42 and 44 are attached to the opposite ends of cable 46. Rear brake assembly 36 is positioned relative to the travel of tambour door 12 so that the central portion of cable 46 extends across a portion of the path of travel of projection 32 and projection 32 engages cable 46 a sufficient distance before the door would reach its closed position so as to effectively prevent undesirable acceleration of the door. Generally, this engagement will occur near the end of the travel of tambour door 12 from the open to the closed position. As previously mentioned, it is near the end of its travel from the open to the closed position that tambour door 12 is accelerating under the influence of gravity and at which the opposing force provided by rear braking assembly 36 is required. The specific positioning of the braking assembly is dependent upon the spring force constant of springs 42 and 44 as compared to the weight of the tambour door. The overall objective is to ensure that the tambour closes gently without slamming.

Figure 5A:
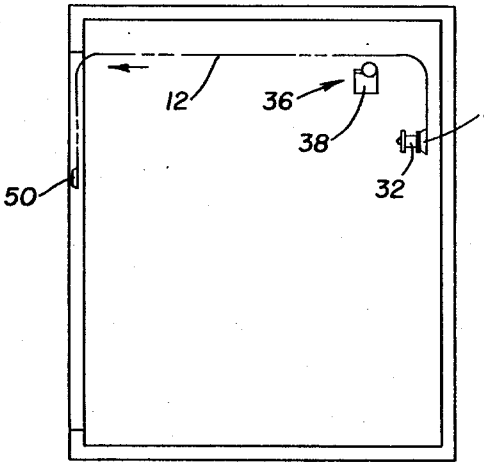
FIGS. 5A–5C are mechanical schematic views that illustrate the specific embodiment of FIG. 1 in several positions during the travel of the tambour door.
Figure 5B:
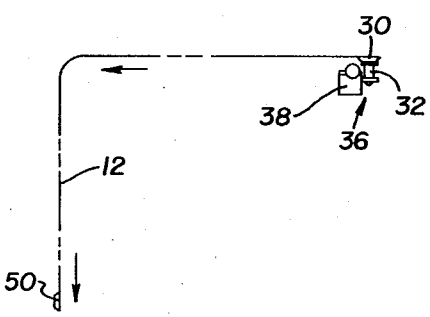
Figure 5C:
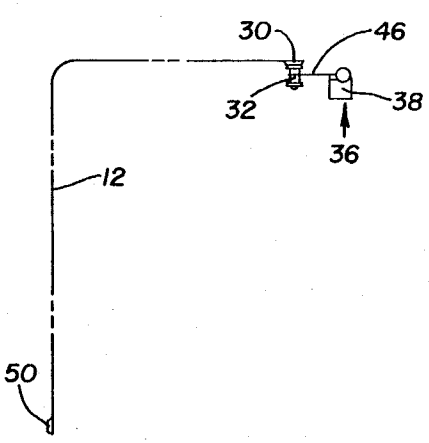

The operation of rear brake assembly 36 is schematically illustrated in FIGS. 5A through 5C. In FIG. 5A, tambour door 12 is moving from the open to the closed position under externally provided force such as from a person pulling down on the front edge of the door. The door 12 as positioned in FIG. 5A has just passed the equilibrium position, but before the projection 32 has engaged the cable of the rear braking assembly.

In FIG. 5B, tambour door 12 has travelled past the equilibrium point in its travel to the closed position and to the point at which projection 32 just begins to engage cable 46. It is at this general point in the travel of the door that gravitational forces are being exerted upon tambour door 12 causing its speed of travel to accelerate in an undesirable fashion in the absence of a rear brake assembly. Upon projection 32 engaging cable 46, the springs 42 and 44 begin to exert an opposing force that counteracts to some extent the gravitational forces exerted on the door. The degree that the springs counteract these gravitational forces depends directly upon the stiffness and strength of the springs, i.e. spring force constant, and the weight of the tambour door.

In FIG. 5C, tambour door 12 is illustrated as having reached its closed position. As is illustrated, projection 32 upon engaging cable 46 moves cable 46 from an unengaged position such as that illustrated in FIG. 5A to a fully extended and engaged position as illustrated in FIG. 5C. As previously described, springs 42 and 44 exert a biasing or opposing force upon tambour door 12 so as to prevent tambour door 12 from accelerating in an undesirable fashion due to gravitational forces. The end result of all of this is that tambour door 12 closes in a relatively gentle fashion without slamming shut.

Figure 4:
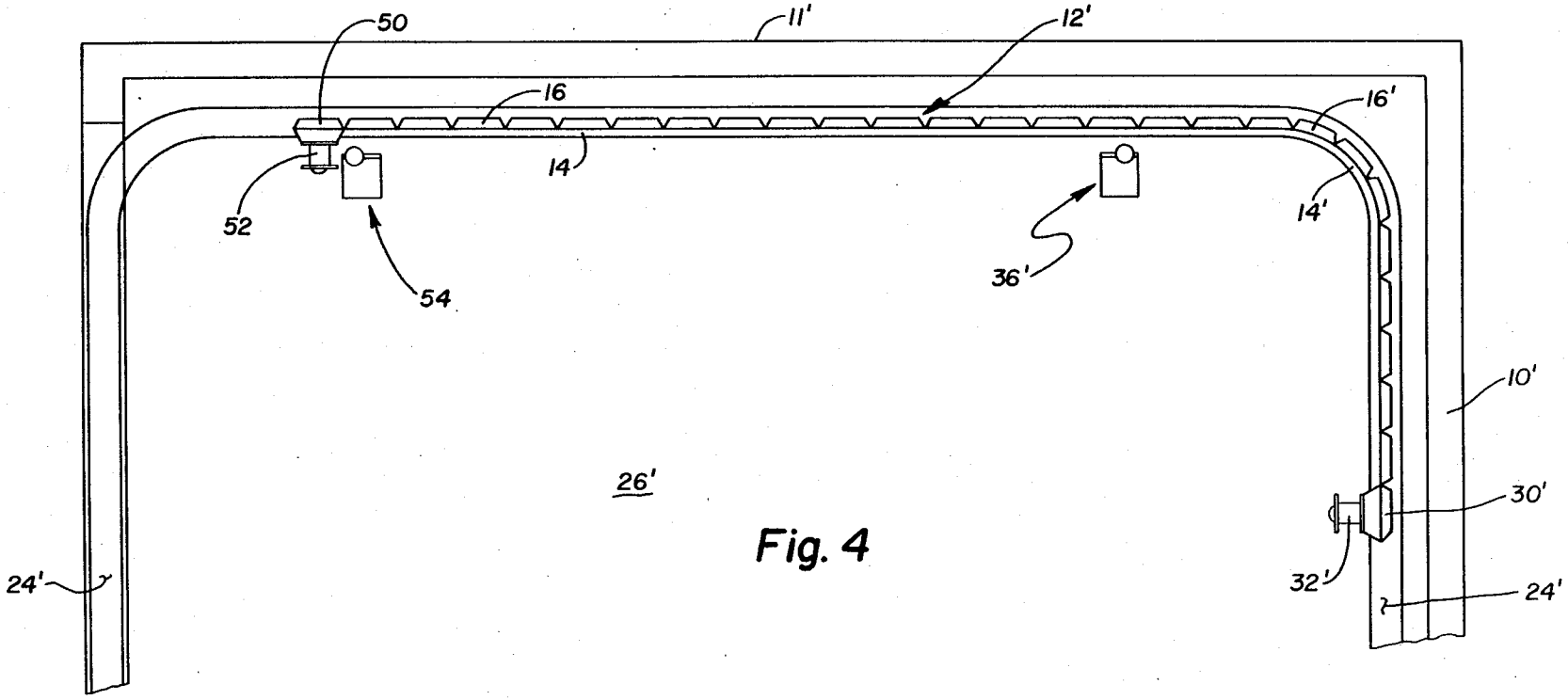
FIG. 4 is a side view of an alternate specific embodiment that utilizes both a front brake assembly and a rear brake assembly.

In FIG. 4 there is illustrated another specific embodiment of the invention which utilizes, in addition to rear brake assembly 36' which is identical to rear brake assembly 36, a front brake assembly generally designated as 54. In regard to the description of front brake assembly 54, it should be appreciated that tambour door 12' further includes a front slat 50 to which is mounted front projection 52 such as a bolt or the like.

Figure 7:
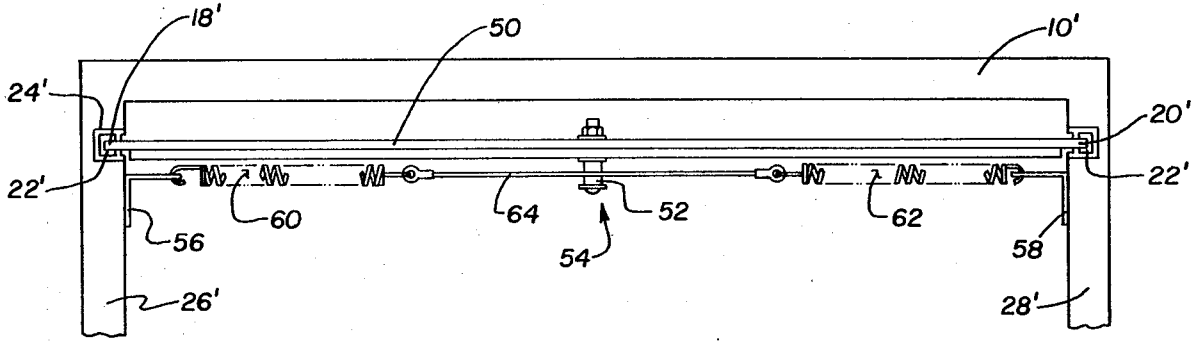
FIG. 7 is a front view of the front braking assembly of the alternate specific embodiment of FIG. 4.

Referring to FIG. 7, front brake assembly 54 includes a pair of brackets 56 and 58 mounted to the interior surfaces of side walls 26 and 28, respectively. Further, each one of elongate springs 60 and 62 is connected at one end thereof to brackets 56 and 58, respectively. Elongate springs 60 and 62 are connected at their other ends to the opposite ends of cable 64. Front brake assembly 54 is positioned relative to the travel of tambour door 12 so that the central portion of cable 64 extends across a portion of the path of travel of projection 52 and projection 52 engages cable 64 only near the end of the travel of tambour door 12 from the closed to open position. It is near the end of its travel from the closed to the open position that tambour door 12 is accelerating under the influence of gravity and at which the counteracting or opposing force provided by front braking assembly 54 is required. The considerations regarding the specific positioning of the front brake assembly are the same as those for the rear brake assembly. However, it should be kept in mind that the rear brake assembly sets on a closing door and the front brake assembly acts on an opening door.

Figure 6A:
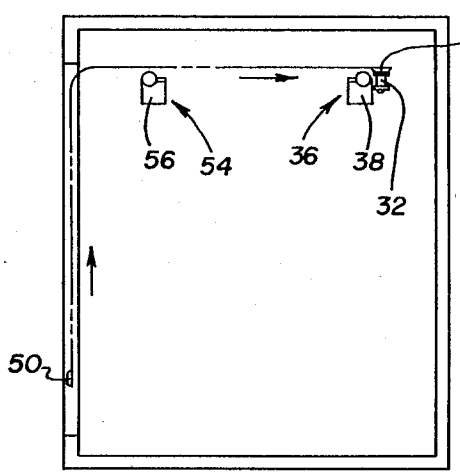
FIGS. 6A–6C are mechanical schematic views that illustrate the specific embodiment of FIG. 4 in several positions during the travel of the tambour door.
Figure 6B:
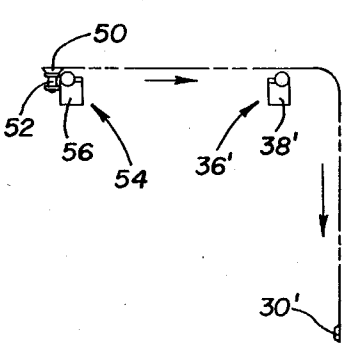
Figure 6C:
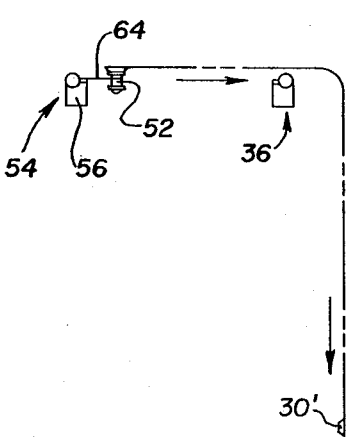

The operation of front brake assembly 54 is schematically illustrated in FIGS. 6A–6C. In FIG. 6A, tambour door 12 is illustrated as being moved under an externally provided force, such as a person pushing up on the front edge of the door, from the closed to the open position. The door 12 as positioned in FIG. 6A has not yet reached the equilibrium position nor has the projection 52 engaged the cable 64 of front braking assembly 54.

In FIG. 6B, the tambour door 12 is illustrated as being at a position in its travel from the closed to the open position wherein projection 52 is almost about to engage cable 64. It is at this general point in the travel of the door that gravitational forces are exerted upon door 12 that would cause its speed to accelerate in the absence of front brake assembly 54. By projection 52 engaging cable 64, springs 60 and 62 begin to exert a force opposing the gravitational forces exerted on the door. The degree to which the springs counteract the gravitational force exerted on the door depends directly upon the stiffness and strength of the spring, i.e. spring force constant, and the weight of the tambour door.

In FIG. 6C, tambour door 12 is illustrated in its fully open position. Projection 52 has now engaged cable 64 and moved it from an unengaged position to a fully extended and engaged position. As previously described, upon engagement of cable 64, spring 60 and 62 exert a biasing force to counteract the gravitational force exerted upon door 12 so that door 12 does not undesirably accelerate its speed of travel. The end result of this being that tambour door 12 moves to its open position in a relatively gentle fashion without slamming open.

In addition to providing a braking capability, both the front and rear braking assemblies assist the initial movement of the door from the open-to-the-closed and the closed-to-the-open positions, respectively. As illustrated in FIG. 6C, the tambour door is in its open position with the springs extended and exerting a force against the door. However, the weight of the door is sufficiently large so that the spring force alone cannot move the door from the open position. When an external force is exerted on the door to close it, i.e. a person pulls down on the door, the springs 60 and 62 of the front braking assembly act to assist the person in in moving the door off the open position.

As illustrated in FIG. 5C, the tambour door is in its closed position with the springs 42 and 44 extended and exerting a force against the door. However, the weight of the door is sufficiently large so that the spring force alone cannot move the door from the closed to the open position. When an external force is exerted on the door to open it, i.e. a person pulls up on the door, the springs 42 and 44 of the rear braking assembly act to assist the person in moving the door off the closed position.

Applicant has provided an improved cabinet having a sliding flexible door with an improved braking assembly which effectively operates to brake the travel of the flexible door during the last stages of its travel to either its open position or to its closed position. Applicant's invention also assists the opening and/or closing of the tambour door by helping move the door off of its closed or open positions, respectively. Applicant's invention is relatively simple and inexpensive to construct, and yet provides an effective solution to a previously unsolved problem.

While there have been described above the principles of this invention in connection with specific apparatus, it will be clearly understood that this description is made only by way of example and not as a limitation as to the scope of the invention.

What is claimed is:

1. A cabinet comprising: an enclosure having an opening therein; a tambour door slidably attached to said enclosure, said door slidable between an open position in which access to the interior of the enclosure is provided through the opening and a closed position in which said door closes the opening; and a brake means for restraining the movement of said door as it travels from the open to the closed position, said brake means comprising a spring means connected to one of said door and enclosure, and a projection means on the other of said door and enclosure for contacting said spring means and resiliently stretching said spring means during a later portion of the travel of said door from the open position to the closed position, said spring means exerting a braking force on said door as the door is closed, said projection means being out of contact with said spring means during an earlier free travel portion of the travel of the door from the open toward the closed position.

2. The cabinet of claim 1 wherein said projection means is connected to said door, and said spring means comprises two springs connected to said enclosure and an elongate member connected to and extending between said springs, said elongate member being contacted by said door projection means.

3. The cabinet of claim 2 wherein said door includes a rear slat and said projection means is mounted on said rear slat and projects outwardly therefrom.

4. The cabinet of claim 1 wherein said projection means continues to stretch said spring means when the door is in the fully closed position.

5. The cabinet of claim 1 wherein said spring means is connected to said enclosure and said projection means is connected to said door, said spring means being in the path of movement of said projection means as the door moves between the open and closed positions.

6. The cabinet of claim 5 including a second projection means on said door for contacting and stretching said spring means during a selected portion of travel as the door moves from the closed to the open position, both said projection means being completely out of contact with said spring means during an intermediate free travel portion of the travel of the door.

7. The cabinet of claim 6 wherein said spring means comprises a first spring contacted by said first mentioned projection means and a second spring contacted by said second projection means, said springs being spaced apart in said enclosure.

8. The cabinet of claim 7 wherein said door has a front slat, said second projection means being connected to said front slat.

* * * * *